US008403180B2

(12) United States Patent
Nakatsuka et al.

(10) Patent No.: US 8,403,180 B2
(45) Date of Patent: Mar. 26, 2013

(54) CHEMICALS MIXING CONTAINER WITH ELASTIC PARTITION WALL

(75) Inventors: Toshiyuki Nakatsuka, Kyoto (JP); Yusei Kadobayashi, Kyoto (JP); Satoshi Takano, Kyoto (JP)

(73) Assignee: Kabushiki Kaisha Shofu, Kyoto (JP)

( * ) Notice: Subject to any disclaimer, the term of this patent is extended or adjusted under 35 U.S.C. 154(b) by 439 days.

(21) Appl. No.: 12/673,619

(22) PCT Filed: Aug. 16, 2007

(86) PCT No.: PCT/JP2007/065962

§ 371 (c)(1),
(2), (4) Date: Feb. 16, 2010

(87) PCT Pub. No.: WO2009/022426

PCT Pub. Date: Feb. 19, 2009

(65) Prior Publication Data

US 2011/0017777 A1 Jan. 27, 2011

(51) Int. Cl.
*B67D 7/78* (2010.01)

(52) U.S. Cl. ..... 222/145.5; 222/386.5; 222/406; 222/424.5

(58) Field of Classification Search ..... 222/145.1, 222/145.5, 342, 378, 386, 386.5, 406, 407, 222/424.5; 206/219, 221; 215/DIG. 8; 433/90; 604/191, 218

See application file for complete search history.

(56) References Cited

U.S. PATENT DOCUMENTS

| | | | | |
|---|---|---|---|---|
| 97,165 | A * | 11/1869 | Cederholm | 604/218 |
| 3,319,420 | A * | 5/1967 | Mercier | 222/386.5 |
| 3,828,778 | A * | 8/1974 | Weinhart | 604/218 |
| 4,381,779 | A | 5/1983 | Margulies | |
| 4,986,820 | A | 1/1991 | Fischer | |
| 5,172,807 | A * | 12/1992 | Dragan et al. | 206/221 |
| 5,392,904 | A * | 2/1995 | Frick et al. | 206/219 |
| 5,445,523 | A * | 8/1995 | Fischer et al. | 433/90 |
| 5,599,312 | A | 2/1997 | Higashikawa | |
| 6,997,910 | B2 * | 2/2006 | Howlett et al. | 604/191 |
| 2001/0053511 | A1 * | 12/2001 | Aoyagi et al. | 433/90 |
| 2007/0272567 | A1 * | 11/2007 | Peuker et al. | 206/219 |
| 2011/0027751 | A1 * | 2/2011 | Kojima et al. | 433/90 |

(Continued)

FOREIGN PATENT DOCUMENTS

| | | |
|---|---|---|
| EP | 0695555 | 2/1996 |
| JP | 58-69574 | 4/1983 |

(Continued)

OTHER PUBLICATIONS

International Search Report issued Oct. 23, 2007 in International (PCT) Application No. PCT/JP2007/065962.

(Continued)

*Primary Examiner* — Kevin P Shaver
*Assistant Examiner* — Patrick M Buechner
(74) *Attorney, Agent, or Firm* — Wenderoth, Lind & Ponack, L.L.P.

(57) ABSTRACT

A chemicals mixing container includes: a cylinder (8) having a tubular shaped outer tube (10), and an end wall (11) which seals one end of the outer tube; an elastic partition wall (12) placed inside the outer tube to define a mixing chamber (5) within the cylinder; and an ejection auxiliary member (13) placed inside the outer tube and outside the mixing chamber, and which has an end face swollen toward the mixing chamber and moreover which is enabled to press the elastic partition wall against the end wall. The chemicals mixing container is enabled to reliably mix a liquid material and a powder material together and discharge a mixture (18) of the liquid material and the powder material without waste.

12 Claims, 7 Drawing Sheets

U.S. PATENT DOCUMENTS

2011/0056984 A1* 3/2011 Cheetham ..... 222/386

FOREIGN PATENT DOCUMENTS

| | | |
|---|---|---|
| JP | 63-264055 | 10/1988 |
| JP | 6-327771 | 11/1994 |
| JP | 2007-61633 | 3/2007 |
| WO | 85/00524 | 2/1985 |
| WO | 91/00114 | 1/1991 |
| WO | 94/12227 | 6/1994 |

OTHER PUBLICATIONS

Patent Cooperation Treaty (PCT) International Preliminary Report on Patentability issued Mar. 9, 2010 in corresponding to International Application No. PCT/JP2007/065962.

Notice of Reason for Rejection (with English translation) issued Nov. 8, 2011 in corresponding Japanese Patent Application No. 2009-528014.

* cited by examiner

CHEMICALS MIXING CONTAINER WITH ELASTIC PARTITION WALL

BACKGROUND OF THE INVENTION

1. Technical Field

The present invention relates to a chemicals mixing container which contains two kinds of chemicals in isolation from each other and which, at a time of use, allows those chemicals to be mixed together inside the container before being discharged. For example, the invention relates to such a chemicals mixing container as a dental cement capsule which contains a powder material and a liquid material as the two kinds of chemicals in isolation from each other and which allows the powder material and the liquid material to be mixed together before being discharged.

2. Description of the Related Art

For chemicals mixing containers such as dental cement capsules, it is desired that with two kinds of chemicals such as a powder material and a liquid material stored in isolation from each other, the chemicals mixing container is enabled to, at the time of use, mix together the two kinds of chemicals inside the chemicals mixing container and to eject the resulting mixture (or reaction product) from the chemicals mixing container with the least possible residues of the mixture.

Among conventional chemicals mixing containers is one in which a mixing chamber for mixing together two kinds of chemicals is formed by a tubular shaped cylinder with one end sealed by an end wall, and a piston for ejecting the mixture of chemicals (see, e.g., JP 2007-61633 and JP S63-264055). In order to allow the mixture of chemicals to be discharged without remainders, the configuration of an end face of the piston needs to have such a copied form as to be closely contactable with an inner wall surface of an end wall of the cylinder roughly without clearances. As a result of this, there would be some cases where an inner wall surface of the cylindrical portion of the cylinder and the inner wall surface of the end wall of the cylinder or an end face of the piston forms as narrow an interior angle as 90° or smaller so that chemicals tend to be accumulated at corners of the mixing chamber, making it impossible to achieve uniform stirring and mixing of chemicals.

SUMMARY OF THE INVENTION

1. Problems to be Solved by the Invention

In view of these and other problems, an object of the present invention is to provide a chemicals mixing container which allows a plurality of chemicals to be mixed reliably and which allows a mixture of the chemicals to be discharged without waste.

2. Means for Solving the Problems

In order to achieve the above object, the present invention provides a chemicals mixing container comprising: a cylinder having a tubular shaped outer tube, and an end wall which seals one end of the outer tube and in which an ejection hole has preliminarily been formed or is formable and which has an inner wall surface swollen outward; an elastic partition wall which is placed inside the outer tube so as to be able to define a mixing chamber within the cylinder, and which has such elasticity as to be swollen toward one side counter to the inner wall surface of the end wall; and an ejection auxiliary member which is placed inside the outer tube and outside the mixing chamber, and which has an end face swollen toward the mixing chamber and moreover which is enabled to press the elastic partition wall against the end wall.

According to this construction, since interior angles of the mixing chamber formed by the inner wall surface of the outer tube of the cylinder and the inner wall surface of the end wall as well as the elastic partition wall are such large that the chemicals are less likely to be accumulated at the corners of the mixing chamber, it becomes possible to achieve uniform stirring and mixing of two kinds of chemicals. Also, for ejection of the mixture of the chemicals, the elastic partition wall is pressed, and thereby elastically deformed, by the ejection auxiliary member so as to be caved inward of the mixing chamber, by which a clearance between the inner wall surface of the end wall of the cylinder and the elastic partition wall is lessened. Thus, the mixture of the chemicals can be ejected without waste.

In the chemicals mixing container of the invention, the ejection auxiliary member may be formed into a convex shape taking after the inner wall surface of the end wall of the cylinder.

According to this construction, by the elastic partition wall being brought into close contact with the inner wall surface of the end wall of the cylinder, the mixture of the chemicals can be ejected without remainders.

In the chemicals mixing container of the invention, the elastic partition wall and the ejection auxiliary member may be formed so as to be integrated together.

According to this construction, since the elastic partition wall and the ejection auxiliary member are integrated together, the parts count does not increase.

In the chemicals mixing container of the invention, it may be that the elastic partition wall has a tubular shaped cylindrical portion which is in contact with an inner wall surface of the outer tube and which extends outward of the mixing chamber, and the ejection auxiliary member is fitted in the cylindrical portion of the elastic partition wall.

According to this construction, since close contact of the cylindrical portion of the elastic partition wall against the inner wall surface of the outer tube of the cylinder is ensured, the mixture of the chemicals can be extend without leakage.

In the chemicals mixing container of the invention, the chemicals mixing container may include a dispensing chamber which is communicatable with the mixing chamber.

According to this construction, it becomes possible to contain different chemicals in the mixing chamber and the dispensing chamber, respectively, and mix them together when necessary.

3. Effects of the Invention

According to the present invention, since the inner wall surface of the end wall of the cylinder and the elastic partition wall are swollen outward, large interior angles of corners of the mixing chamber are provided, allowing uniform stirring and mixing of the chemicals to be achieved. Also, for ejection of the mixture of the chemicals, the elastic partition wall can be caved inward of the mixing chamber to compress the mixing chamber, so that the mixture of the chemicals can be ejected without waste.

REFERENCE NUMERALS

Figure 1:
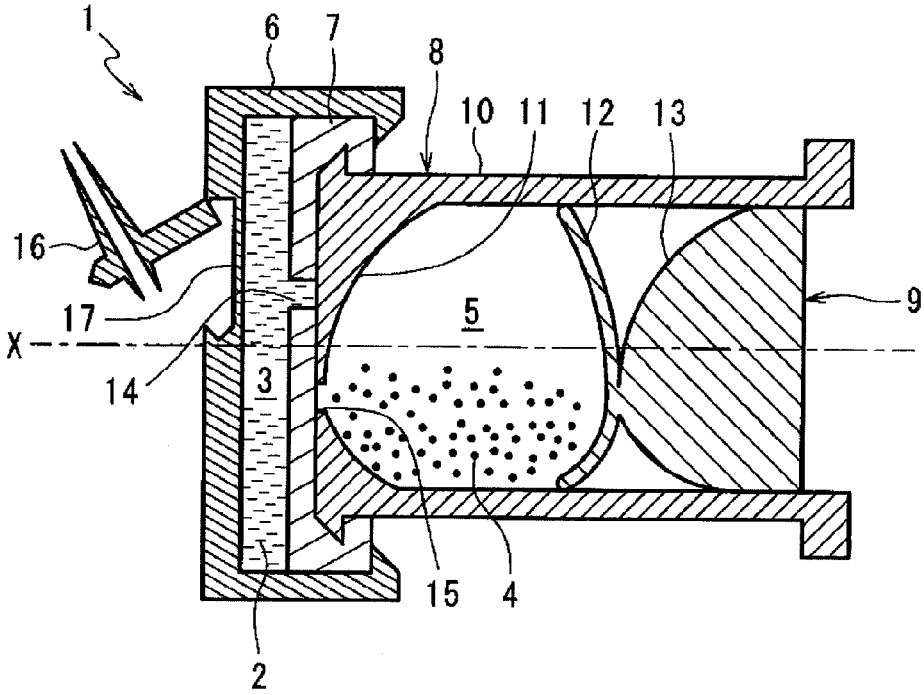
FIG. 1 is a sectional view of a storage state of a chemicals mixing container according to a first embodiment of the present invention.

1 chemicals mixing container
2 liquid material (chemical)
3 dispensing chamber
4 powder material (chemical)
5 mixing chamber
6 dispensing cylinder
7 dispensing piston
8 mixing cylinder
9 ejecting piston
10 outer tube
11 end wall
12 elastic partition wall
13 ejection auxiliary member
15 communicating hole (ejection hole)

DETAILED DESCRIPTION OF THE INVENTION

Hereinbelow, embodiments of the present invention will be described in detail with reference to the accompanying drawings.

FIG. 1 shows a chemicals mixing container 1 according to a first embodiment of the invention. The chemicals mixing container 1 stores therein two kinds of chemicals, isolatedly, particularly a powder material and a liquid material, for generating amalgam or other dental materials, bone cement or other medical materials and the like, and at a time of use, the chemicals mixing container 1 is to mix constituents of those materials to generate a desired mixture (or reaction product) and, as required, eject (extrude out) the mixture.

The chemicals mixing container 1 has a dispensing chamber 3 for containing a liquid material 2, and a mixing chamber 5 for containing a powder material 4. The dispensing chamber 3 is defined by a generally tubular shaped dispensing cylinder 6 and a generally disc-shaped dispensing piston 7 fitted in the dispensing cylinder 6. The mixing chamber 5 is defined by a generally tubular shaped mixing cylinder 8 connected to an outer side of the dispensing piston 7 so as to be rotationally slidable thereon, and an ejecting piston 9 fitted in the mixing cylinder 8.

The mixing cylinder 8 has a tubular shaped outer tube 10, and an end wall 11 which includes a flat outer wall surface serving as a sliding surface for the dispensing piston 7, and an inner wall surface curved to make the mixing chamber 5 swollen outside. The ejecting piston 9 is composed of an elastically-deformable, thin plate-shaped elastic partition wall 12, and an ejection auxiliary member 13 connected to an outer side of the elastic partition wall 12. The elastic partition wall 12 is in air-tight sliding contact with the inner wall surface of the outer tube 10 of the mixing cylinder 8 over its entire periphery and curved so as to make the mixing chamber 5 swollen toward one side counter to the dispensing piston 7. The ejection auxiliary member 13, which has a convex-shaped end face taking after the shape of the inner wall surface of the end wall 11 of the mixing cylinder 8, is formed integrally with the elastic partition wall 12.

In sliding surfaces of the dispensing piston 7 and the mixing cylinder 8, communicating holes 14, 15 are formed at positions, respectively, which are eccentric by an equal distance from a rotation axis X of the rotational sliding. In market distribution of the chemicals mixing container 1 and in its storage at medical offices, rotational positions of the dispensing piston 7 and the mixing cylinder 8 are so determined that the communicating holes 14 and 15 are positionally different from each other as shown in FIG. 1, thereby making the dispensing chamber 3 and the mixing chamber 5 isolated from each other.

Also, the dispensing cylinder 6 has, outside a wall of one end face thereof, a nozzle 16 formed in integrated connection. The nozzle 16, which swings against the dispensing cylinder 6, is fittable to a fitting recess 17 provided outside the end face of the dispensing cylinder 6. When the nozzle 16 is fitted to the fitting recess 17, a protrusion of the nozzle 16 extends through a small-thickness bottom portion of the fitting recess 17 so that the dispensing chamber 3 is opened to the outward via the nozzle 16.

Figure 2:
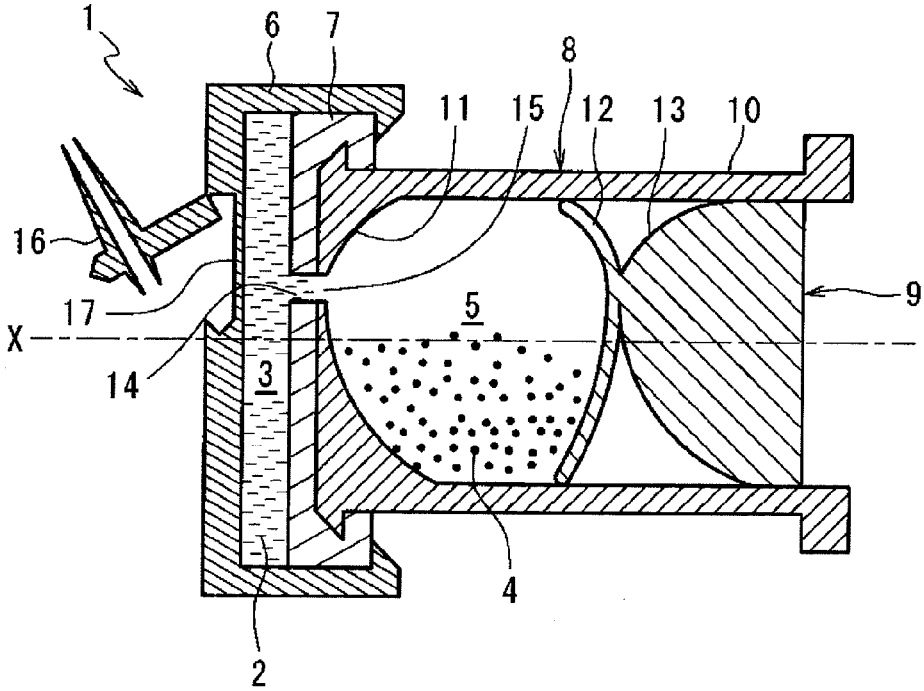
FIG. 2 is a sectional view showing a first step for use of the chemicals mixing container of FIG. 1.

For use of the chemicals mixing container 1, first, as shown in FIG. 2, the mixing cylinder 8 is rotated relative to the dispensing piston 7 so that the communicating hole 14 of the dispensing piston 7 and the communicating hole 15 of the mixing cylinder 8 are communicated with each other.

Figure 3:
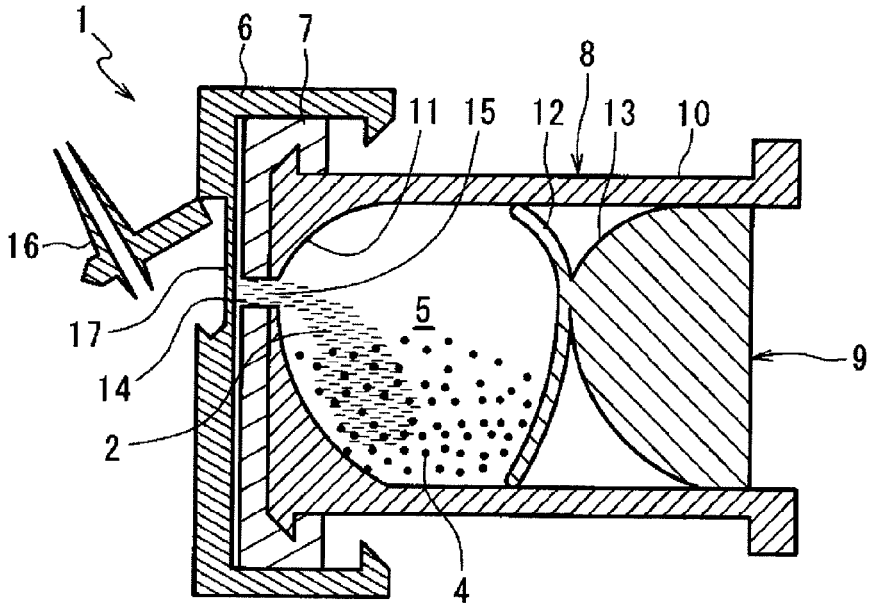
FIG. 3 is a sectional view showing a second step for use of the chemicals mixing container of FIG. 1.

Then, as shown in FIG. 3, the dispensing piston 7 along with the mixing cylinder 8 and the ejecting piston 9 is pushed deep in the dispensing cylinder 6 to compress the dispensing chamber 3. As a result, the liquid material 2 contained in the dispensing chamber 3 flows into the mixing chamber 5 via the communicating holes 14, 15.

After the liquid material 2 is injected into the mixing chamber 5, the chemicals mixing container 1 is well shaken to mix together the liquid material 2 and the powder material 4 to form a mixture (or reaction product) 18. In this case, the inner wall surface of the end wall 11 of the mixing cylinder 8 and the elastic partition wall 12 of the ejecting piston 9 are outwardly swollen in shaped so as to provide larger interior angles of corners formed against the inner wall surface of the outer tube 10 of the mixing cylinder 8, so that the liquid material 2 and the powder material 4 are less likely to be accumulated at the corners of the mixing chamber 5. This facilitates an unevenness-free, uniform mixing of the liquid material 2 and the powder material 4.

Figure 4:
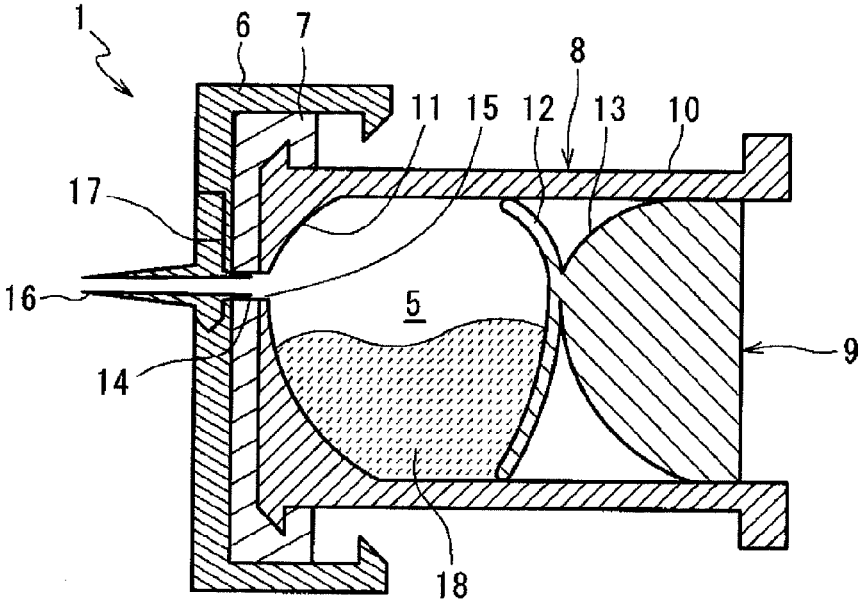
FIG. 4 is a sectional view showing a third step for use of the chemicals mixing container of FIG. 1.

Once the liquid material 2 and the powder material 4 have been mixed enough, the nozzle 16 is set to the fitting recess 17 so as to form an ejection path for the mixture 18 of the liquid material 2 and the powder material 4 as shown in FIG. 4.

Figure 5:
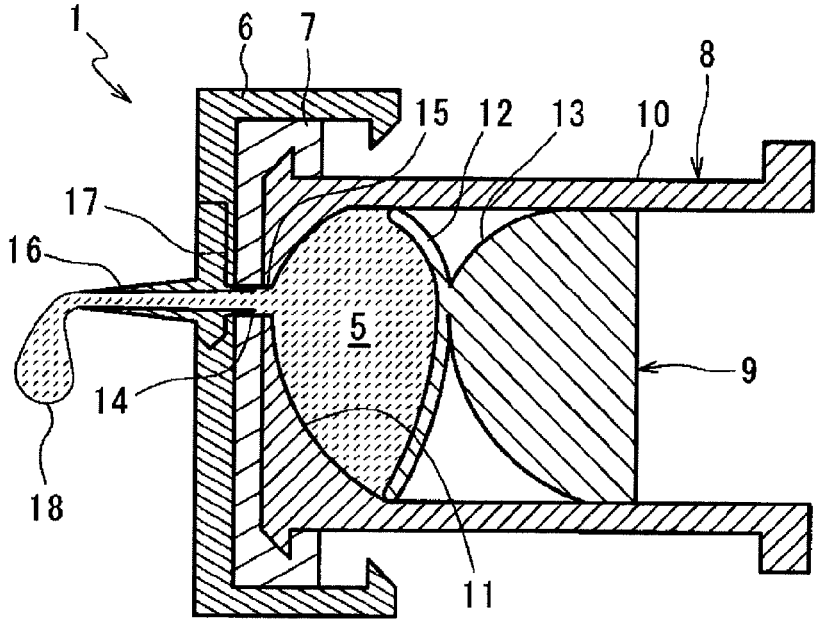
FIG. 5 is a sectional view showing a fourth step for use of the chemicals mixing container of FIG. 1.

Then, as shown in FIG. 5, pushing in the ejecting piston 9 allows the mixture 18 within the mixing chamber 5 to be extruded out through the nozzle 16. That is, the communicating hole 15 in the end wall 11 of the mixing cylinder 8 serves as an ejection hole for ejecting the mixture 18 from the mixing chamber 5 via the nozzle 16.

The inner wall surface of the end wall 11 of the mixing cylinder 8 and the elastic partition wall 12 of the ejecting piston 9 are curved in mutually counter directions so as to make the mixing chamber 5 swollen outward. Therefore, as shown in FIG. 5, the outer peripheral portion of the elastic partition wall 12 comes into contact with the inner wall surface of the end wall 11 before the mixing chamber 5 is compressed small enough.

Figure 6:
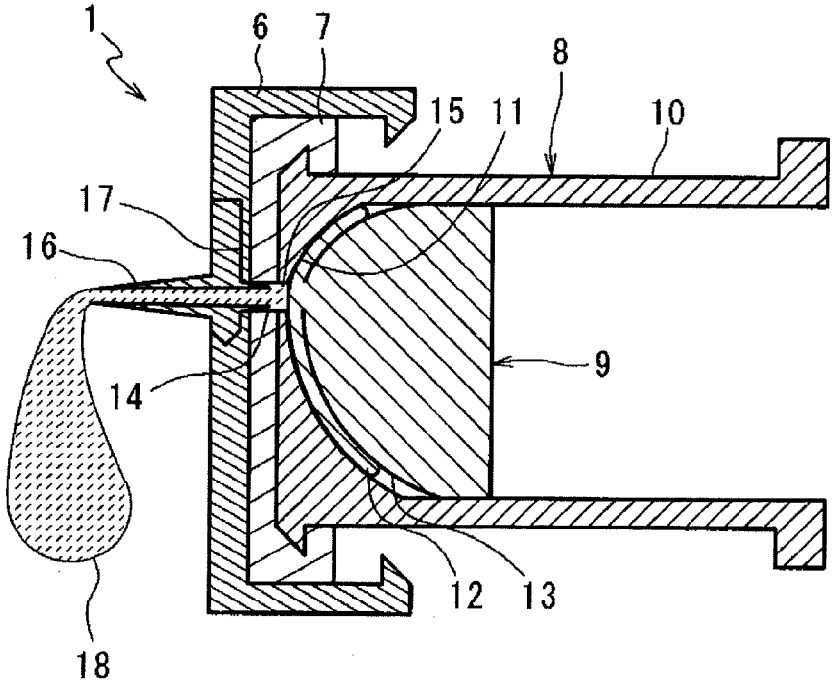
FIG. 6 is a sectional view showing a fifth step for use of the chemicals mixing container of FIG. 1.

However, since the elastic partition wall 12 is elastically deformable, further pushing in the ejecting piston 9 allows the elastic partition wall 12 to be warped in a reverse direction so as to be caved inward of the mixing chamber 5 until the outer peripheral portion of the elastic partition wall 12 comes into contact with the ejection auxiliary member 13 as shown in FIG. 6. Since the ejection auxiliary member 13 has a shape taking after the inner wall surface of the end wall 11, the ejecting piston 9 can make the mixing chamber 5 generally zero in capacity as shown in the figure. That is, the mixture 18 resulting from mixing together the liquid material 2 and the powder material 4 is ejected eventually in its generally full amount from the nozzle 16 according to a push-in extent of the ejecting piston 9.

Figure 7:
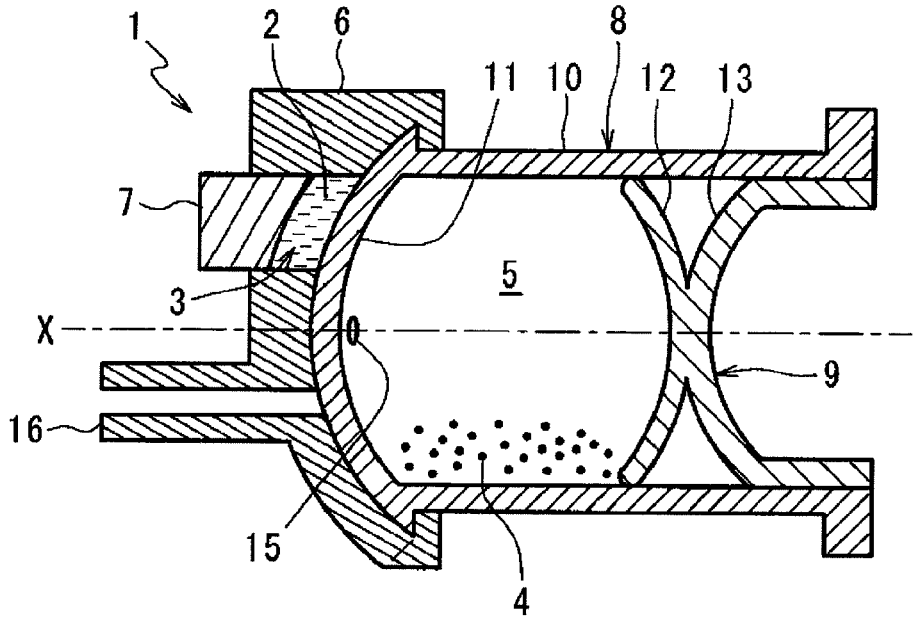
FIG. 7 is a sectional view of a storage state of a chemicals mixing container according to a second embodiment of the invention.

Further, FIG. 7 shows a chemicals mixing container 1 according to a second embodiment of the invention. It is noted that in the following description, the same component members as those described above are designated by the same reference signs and their description is omitted.

In the chemicals mixing container 1, the mixing cylinder 8 is connected to the dispensing cylinder 6 so as to be rotationally slidable thereon. In this embodiment, the dispensing chamber 3 is smaller in diameter than the mixing chamber 5 and eccentric to the rotation axis X of the dispensing cylinder 6 and the mixing cylinder 8. In this embodiment, the nozzle 16 is formed so as to be preliminarily opened to the sliding surface of the dispensing cylinder 6 against the mixing cylinder 8.

Figure 8:
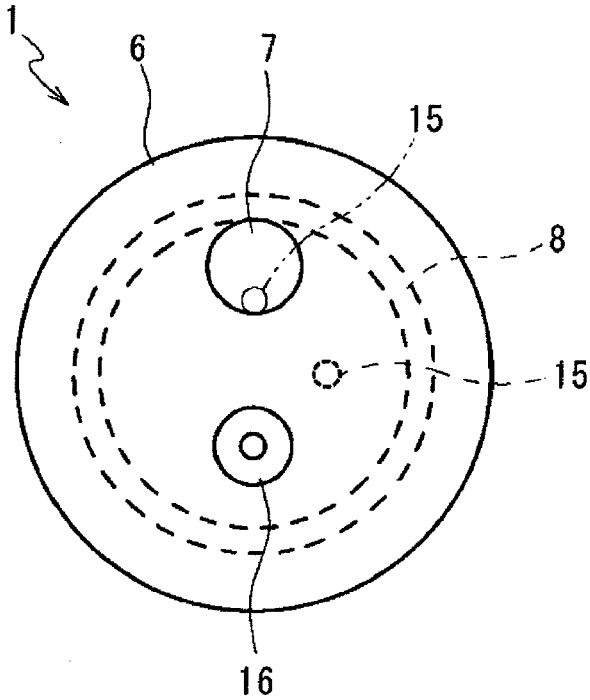
FIG. 8 is a front view of the chemicals mixing container of FIG. 7.

FIG. 8 shows a state of the chemicals mixing container 1 of this embodiment as viewed from its front on the nozzle 16 side. As shown in the figure, the communicating hole 15 of the mixing cylinder 8 can be communicated with either the dispensing chamber 3 or the nozzle 16 depending on a rotational position of the mixing cylinder 8 relative to the dispensing cylinder 6.

Figure 9:
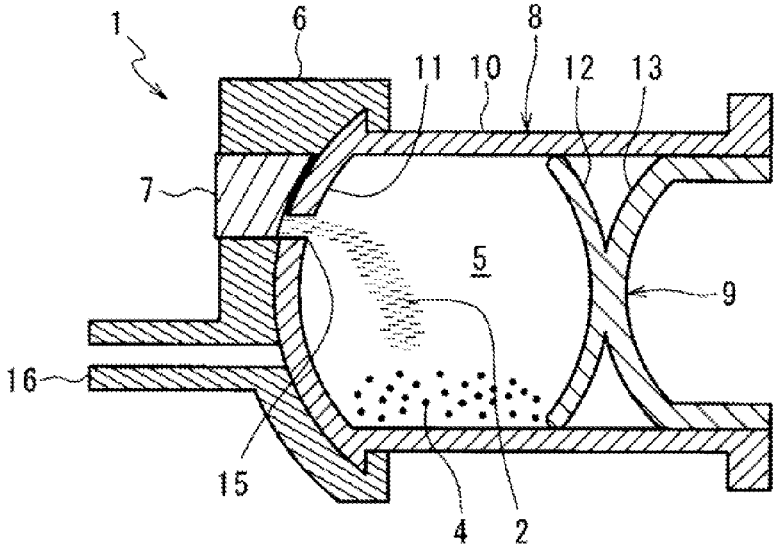
FIG. 9 is a sectional view showing a step for use of the chemicals mixing container of FIG. 7.

Consequently, also in the chemicals mixing container 1 of this embodiment, by rotating the mixing cylinder 8 relative to the dispensing cylinder 6 so that the communicating hole 15 is communicated with the dispensing chamber 3, the liquid material 2 can be injected into the mixing chamber 5 as shown in FIG. 9.

The mixing chamber 5 of this embodiment also is a space which has no acute interior angles and which is formed by the inner wall surface of the tubular shaped outer tube 10 of the mixing cylinder 8, the outwardly swollen inner wall surface of the end wall 11, and the outwardly swollen elastic partition wall 12. Therefore, the liquid material 2 or the powder material 4 is less likely to be accumulated at corners, making it possible to achieve an efficient stirring.

In this embodiment, further, by rotating the mixing cylinder 8 relative to the dispensing cylinder 6 so that the communicating hole (ejection hole) 15 is communicated with the nozzle 16, the mixture 18 resulting from mixing together the liquid material 2 and the powder material 4 can be ejected in its generally full amount from the nozzle 16 according to a push-in extent of the ejecting piston 9.

Figure 10:
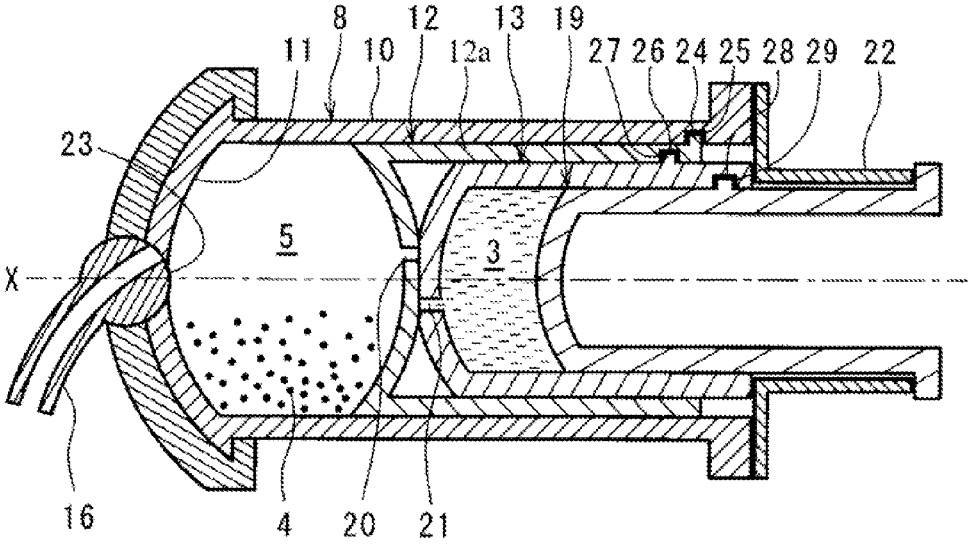
FIG. 10 is a sectional view of a storage state of a chemicals mixing container according to a third embodiment of the invention.

Further, FIG. 10 shows a chemicals mixing container 1 according to a third embodiment of the invention. In this embodiment, the elastic partition wall and the ejection auxiliary member 13 are formed independent of each other. The elastic partition wall 12 has a cylindrical portion 12*a* which extends cylindrically outside the mixing chamber 5 so as to be inscribed on the inner wall surface of the outer tube 10 of the mixing cylinder 8. The ejection auxiliary member 13 is a generally tubular shaped cylinder which is fitted into the cylindrical portion 12*a* of the elastic partition wall 12 and which has an end wall having, at one end, a convex shaped end face taking after the inner wall surface of the end wall of the mixing cylinder 8. Further, in this chemicals mixing container 1, an operation piston 19 is fitted within the cylindrical portion of the ejection auxiliary member 13, and the dispensing chamber 3 for containing the liquid material 2 is formed inside the ejection auxiliary member 13.

The ejection auxiliary member 13 is rotatable relative to the elastic partition wall 12 within a specified angular range while sliding in contact with the elastic partition wall 12. Communicating holes 20, 21 are formed at sliding contact portions of the elastic partition wall 12 and the ejection auxiliary member 13, respectively, and aligning their angular positions with each other allows the dispensing chamber 3 and the mixing chamber 5 to be communicated with each other.

Also, in the chemicals mixing container 1 of this embodiment, a mis-operation preventing collar 22 for preventing mis-operations is fitted between an end portion of the mixing cylinder 8 and a flange of an end portion of the operation piston 19. The mis-operation preventing collar 22 is removable for use of the chemicals mixing container 1.

The nozzle 16 of this embodiment, having a spherical body with a flow-through passage formed therein, is rotatably held to an ejection hole 23 formed in the end wall 11 of the mixing cylinder 8 and serves as a ball valve which makes the flow-through passage communicated with the ejection hole 23 or makes the ejection hole 23 sealed by the spherical surface.

Also, in the inner wall surface of the outer tube of the mixing cylinder 8 is formed a guide groove 25 which receives a protrusion 24 provided at a portion of the outer periphery of the cylindrical portion 12*a* of the elastic partition wall 12 so as to restrict a rotational position of the elastic partition wall 12 relative to the mixing cylinder 8. Similarly, in the inner wall surface of the cylindrical portion 12*a* of the elastic partition wall 12 is formed a guide groove 27 which receives a protrusion 26 provided at a portion of the outer periphery of the cylindrical portion of the ejection auxiliary member 13. In the inner wall surface of the cylindrical portion of the ejection auxiliary member 13 is formed a guide groove 29 which receives a protrusion 28 provided at a portion of the outer periphery of the cylindrical portion of the operation piston 19.

Figure 11:
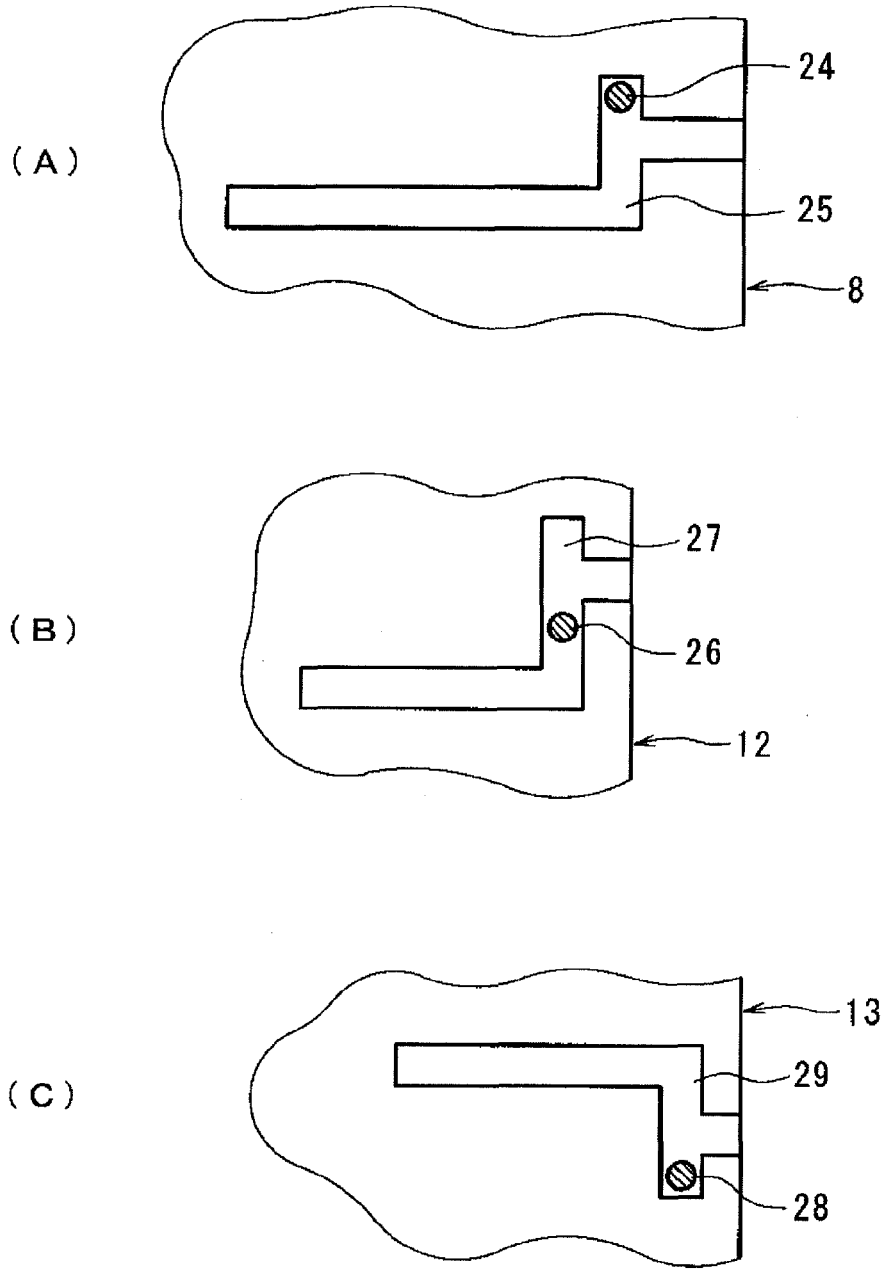
FIG. 11 is a developed view of a rotation restricting structure of the chemicals mixing container of FIG. 10.

These protrusions 24, 26, 28 and the guide grooves 25, 27, 29 make up a rotation restricting structure for ensuring proper operating procedure for the chemicals mixing container 1. FIG. 11 shows a developed view of the rotation restricting structure.

Engagement between the protrusion 24 and the guide groove 25 restricts a rotational range of the elastic partition wall 12 relative to the mixing cylinder 8, making it possible to push the elastic partition wall 12 inward of the mixing cylinder 8 only while the elastic partition wall is in a specified rotational position. Engagement between the protrusion 26 and the guide groove 27 restricts a rotational range of the ejection auxiliary member 13 relative to the elastic partition wall 12, making it possible to push the ejection auxiliary member 13 inward of the elastic partition wall 12 only while the ejection auxiliary member 13 is in a specified rotational position. Engagement between the protrusion 28 and the guide groove 29 restricts a rotational range of the operation piston 19 relative to the ejection auxiliary member 13, making it possible to push the operation piston 19 inward of the ejection auxiliary member 13 only while the operation piston 19 is in a specified rotational position.

FIG. 11 shows the rotation restricting structure of the chemicals mixing container 1 in a storage state before use. In this state, since the protrusions 24, 26, 28 are restricted in their axial movement by the guide grooves 25, 27, 29, respectively, the operation piston 19 cannot be pushed into the mixing cylinder 8, the elastic partition wall 12 and the ejection auxiliary member 13 even if the mis-operation preventing collar 22 is removed.

For use of the chemicals mixing container 1, first, a user rotates the operation piston 19 counterclockwise relative to the mixing cylinder 8. Then, the protrusion 28 of the operation piston 19 is moved to a left end (upper end in FIG. 11(C)) of the guide groove 29 of the ejection auxiliary member 13. Further, the protrusion 28 rotates the guide groove 29, causing the ejection auxiliary member 13 to be rotated counterclockwise relative to the elastic partition wall 12. When this rotation has caused the protrusion 26 to reach a left end (upper end in FIG. 11(B)) of the guide groove 27, that is, has caused the ejection auxiliary member 13 to be positioned at a left end of the rotational range relative to the elastic partition wall 12, the communicating hole 21 of the ejection auxiliary member 13 is communicated with the communicating hole 20 of the elastic partition wall 12. At this point, since the protrusion 24 of the elastic partition wall 12 is at a left end (upper end in FIG. 11(A)) of the guide groove 25 of the mixing cylinder 8, the operation piston 19 and the ejection auxiliary member 13 cannot be rotated counterclockwise any more.

Once the operation piston 19 has been rotated counterclockwise as much as possible, the user is allowed to push the operation piston 19 into the ejection auxiliary member 13. In this state, the protrusion 24 of the elastic partition wall 12 and the protrusion 26 of the ejection auxiliary member 13 are at the left ends of the guide groove 25 of the mixing cylinder 8 and the guide groove 27 of the elastic partition wall 12, respectively, being prohibited from moving in the axial direction. As a result of this, only the operation piston 19 can be pushed into the mixing cylinder 8, i.e., into the ejection auxiliary member 13.

As described above, the chemicals mixing container 1 ensures a proper procedure of, after making the communicating hole 21 of the ejection auxiliary member 13 communicated with the communicating hole 20 of the elastic partition wall 12, pushing the operation piston 19 into the ejection auxiliary member 13 to compress the dispensing chamber 3 so that the liquid material 2 is injected into the mixing chamber 5.

After this chemicals mixing container 1 is shaken enough to mix the liquid material 2 and the powder material 4 together with the mixture 18 generated, the user rotates the operation piston 19 this time clockwise as much as possible so that the nozzle 16 coincides with the ejection hole 23, thus making it possible to push the ejection auxiliary member 13 and the elastic partition wall 12 into the mixing cylinder 8 by the operation piston 19 to extrude the mixture 18 out.

In more detail, since the protrusion 28 has been moved to a depth of the guide groove 29 as a result of pushing the operation piston 19 into the ejection auxiliary member 13, the operation piston 19 cannot be rotated relative to the ejection auxiliary member 13. The ejection auxiliary member 13 is rotated inside the elastic partition wall 12 to make the protrusion 26 moved to a right end (lower end in FIG. 11(B)) of the guide groove 27. As a result of this rotation, the communicating hole 20 of the elastic partition wall 12 and the communicating hole 21 of the ejection auxiliary member 13 are separated from each other. Further, the elastic partition wall 12 is rotated inside the mixing cylinder 8 to make the protrusion 24 moved to the right end (lower end in FIG. 11(A)) of the guide groove 25. As a result, the protrusion 24 and the protrusion 26 are allowed to move deeper (leftward in FIG. 11) in axial portions of the guide groove 25 and the guide groove 27.

An outer peripheral portion of the end wall of the elastic partition wall 12, when coming into contact with the inner wall surface of the end wall 11 of the mixing cylinder 8, is elastically deformed and caved toward the mixing chamber 5 by the ejection auxiliary member 13 to compress the remaining space of the mixing chamber 5, thus allowing the mixture 18 to be discharged via the nozzle 16 without any remainders. Upon the elastic deformation by the ejection auxiliary member 13, the cylindrical portion 12*a* of the elastic partition wall 12 is brought into a wide close contact with the inner wall surface of the outer tube 10 of the mixing cylinder 8, thus ensuring the sealing of the mixing chamber 5.

Figure 12:
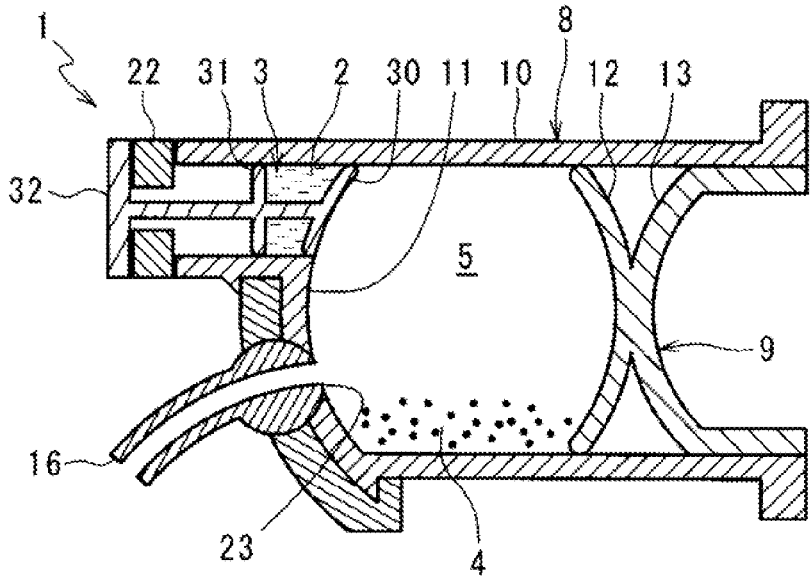
FIG. 12 is a sectional view of a storage state of a chemicals mixing container according to a fourth embodiment of the invention.

Further, FIG. 12 shows a chemicals mixing container 1 according to a fourth embodiment of the invention. In this embodiment, a piston 32 having two partition walls 30, 31 is fitted in the dispensing chamber 3 formed in the end wall of the mixing cylinder 8 in order that the liquid material 2 is contained between the partition walls 30, 31 of the piston 32.

In this embodiment, the piston 32 cannot be pushed in unless the mis-operation preventing collar 22 is removed. Once the piston 32 is pushed in so as to inject the liquid material 2 into the mixing chamber 5, the piston 32 is brought back, thereby sealing the mixing chamber 5 by the partition wall 30. Then, the chemicals mixing container 1 is shaken, by which the liquid material 2 and the powder material 4 are mixed together.

Figure 13:
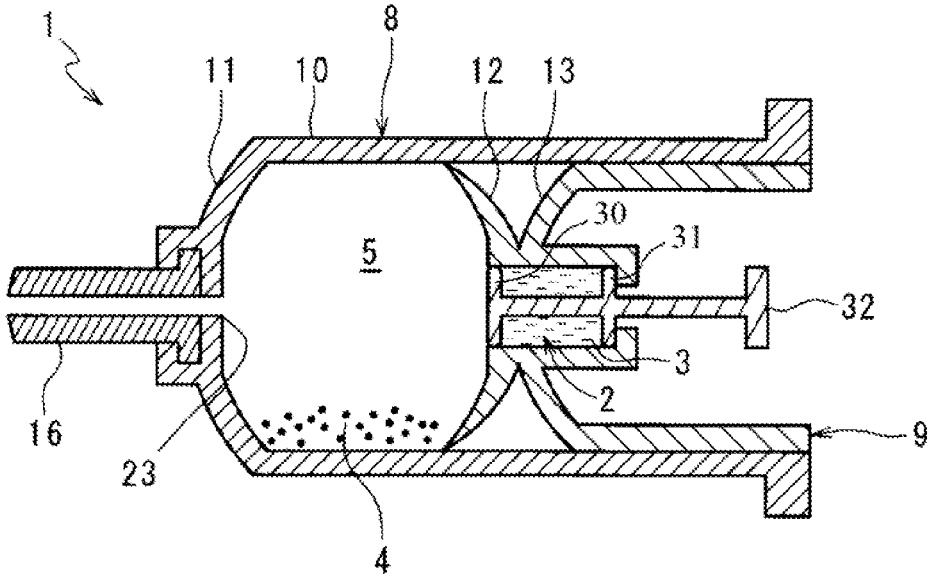
FIG. 13 is a sectional view of a storage state of a chemicals mixing container according to a fifth embodiment of the invention.

Further, FIG. 13 shows a chemicals mixing container 1 according to a fifth embodiment of the invention. In this embodiment, a piston 32 for forming the dispensing chamber 3 to contain the liquid material 2 therein is provided inside the ejecting piston 9 in which the elastic partition wall 12 and the ejection auxiliary member 13 are integrally formed.

As shown by these embodiments, for the present invention, various changes and modifications are possible within such a scope as does not impair the function of the ejection auxiliary member 13 that makes the elastic partition wall 12 swollen inwardly from outside during the ejection of the mixture 18 while the end wall 11 of the mixing cylinder 8 and the elastic partition wall 12 are maintained in outwardly swollen configurations.

The invention claimed is:

1. A chemicals mixing container comprising:

a cylinder having a tubular shaped outer tube, and an end wall which seals one end of the outer tube and in which an ejection hole has preliminarily been formed or is formable and which has an inner wall surface swollen outward;

an elastic partition wall which is placed inside the outer tube so as to be able to define a mixing chamber within the cylinder, and which has such elasticity as to be swollen toward one side counter to the inner wall surface of the end wall; and an ejection auxiliary member which is placed inside the outer tube and outside the mixing chamber, the ejection auxiliary member having an end face swollen toward the mixing chamber, wherein the ejection auxiliary member is operable to cave in the elastic partition wall and press the elastic partition wall toward the end wall of the cylinder and then against the end wall of the cylinder, and wherein the elastic partition wall deforms from a concave shape to a convex shape upon being caved in by the ejection auxiliary member.

2. The chemicals mixing container as claimed in claim 1, wherein the ejection auxiliary member is formed into a convex shape generally conforming to the inner wall surface of the end wall of the cylinder.

3. The chemicals mixing container as claimed in claim 1, wherein the elastic partition wall and the ejection auxiliary member are formed so as to be integrated together.

4. The chemicals mixing container as claimed in claim 1, wherein the elastic partition wall has a tubular shaped cylindrical portion which is in contact with an inner wall surface of the outer tube and which extends outward of the mixing chamber, and the ejection auxiliary member is fitted in the cylindrical portion of the elastic partition wall.

5. The chemicals mixing container as claimed in claim 1, further comprising a dispensing chamber which is communicatable with the mixing chamber.

6. The chemicals mixing container as claimed in claim 2, wherein the elastic partition wall and the ejection auxiliary member are formed so as to be integrated together.

7. The chemicals mixing container as claimed in claim 2, wherein the elastic partition wall has a tubular shaped cylindrical portion which is in contact with an inner wall surface of the outer tube and which extends outward of the mixing chamber, and the ejection auxiliary member is fitted in the cylindrical portion of the elastic partition wall.

8. The chemicals mixing container as claimed in claim 2, further comprising a dispensing chamber which is communicatable with the mixing chamber.

9. The chemicals mixing container as claimed in claim 3, further comprising a dispensing chamber which is communicatable with the mixing chamber.

10. The chemicals mixing container as claimed in claim 4, further comprising a dispensing chamber which is communicatable with the mixing chamber.

11. A chemicals mixing container comprising:

a cylinder having a tubular shaped outer tube, and an end wall which seals one end of the outer tube and in which an ejection hole has preliminarily been formed or is formable and which has an inner wall surface swollen outward;

an elastic partition wall which is placed inside the outer tube so as to be able to define a mixing chamber within the cylinder, and which has such elasticity as to be swollen toward one side counter to the inner wall surface of the end wall; and an ejection auxiliary member which is placed inside the outer tube and outside the mixing chamber, the ejection auxiliary member having an end face swollen toward the mixing chamber, wherein:

the ejection auxiliary member is operable to cave in the elastic partition wall and press the elastic partition wall toward the end wall of the cylinder and then against the end wall of the cylinder;

the ejection auxiliary member is formed into a convex shape generally conforming to the inner wall surface of the end wall of the cylinder;

the elastic partition wall and the ejection auxiliary member are formed so as to be integrated together;

the elastic partition wall and the ejection auxiliary member define a dispensing chamber which is communicatable with the mixing chamber; and the chemicals mixing container further comprises a piston fitted in the dispensing chamber, the piston having two partition walls capable of holding a fluid material, wherein, upon movement of the piston in an axial direction of the cylinder, a space between the partition walls communicates with the mixing chamber to deliver the fluid material to the mixing chamber.

12. A chemicals mixing container comprising:

a cylinder having a tubular shaped outer tube, and an end wall which seals one end of the outer tube and in which an ejection hole has preliminarily been formed or is formable and which has an inner wall surface swollen outward;

an elastic partition wall which is placed inside the outer tube so as to be able to define a mixing chamber within the cylinder, and which has such elasticity as to be swollen toward one side counter to the inner wall surface of the end wall; and an ejection auxiliary member which is placed inside the outer tube and outside the mixing chamber, the ejection auxiliary member having an end face swollen toward the mixing chamber, wherein the ejection auxiliary member is operable to cave in the elastic partition wall and press the elastic partition wall toward the end wall of the cylinder and then against the end wall of the cylinder, the ejection auxiliary member is formed into a convex shape generally conforming to the inner wall surface of the end wall of the cylinder; and the elastic partition wall defines an inner surface opposing the inner wall surface of the end wall of the cylinder, the inner surface forming a concave surface prior to actuation of the ejection auxiliary member and a convex surface after actuation of the ejection auxiliary member.

* * * * *